US009783904B2

(12) United States Patent
Watanabe et al.

(10) Patent No.: US 9,783,904 B2
(45) Date of Patent: Oct. 10, 2017

(54) HIGH-PURITY ELECTROLYTIC COPPER AND ELECTROLYTIC REFINING METHOD THEREOF

(71) Applicant: MITSUBISHI MATERIALS CORPORATION, Tokyo (JP)

(72) Inventors: Mami Watanabe, Naka (JP); Kiyotaka Nakaya, Naka (JP); Naoki Kato, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 81 days.

(21) Appl. No.: 13/915,093

(22) Filed: Jun. 11, 2013

(65) Prior Publication Data

US 2013/0334057 A1 Dec. 19, 2013

(30) Foreign Application Priority Data

Jun. 14, 2012 (JP) ..... 2012-134722

(51) Int. Cl.
*C25C 1/12* (2006.01)
*C25D 3/38* (2006.01)

(52) U.S. Cl.
CPC . *C25D 3/38* (2013.01); *C25C 1/12* (2013.01)

(58) Field of Classification Search
CPC ..... C25C 1/12; C25D 3/38
See application file for complete search history.

(56) References Cited

U.S. PATENT DOCUMENTS 4,792,369 A 12/1988 Ogata et al.
5,342,698 A * 8/1994 Fujisawa ..... F16C 33/12 384/912
5,820,653 A * 10/1998 Eamon et al. ..... 75/743
2006/0216539 A1* 9/2006 Takayanagi ..... C22C 12/00 428/642

FOREIGN PATENT DOCUMENTS

JP 03-004629 B 1/1991
JP 4518262 B 8/2010
WO WO-2006-134724 A1 12/2006

* cited by examiner

*Primary Examiner* — Ciel Thomas
(74) *Attorney, Agent, or Firm* — Locke Lord LLP; James E. Armstrong, IV; Nicholas J. DiCeglie, Jr.

(57) ABSTRACT

This electrolytic refining method of high-purity electrolytic copper includes: performing electrolysis by using an electrolyte which includes a copper nitrate solution, a cathode made of stainless steel, and an anode made of copper so as to deposit high-purity electrolytic copper on the cathode.

(a) The electrolyte includes a mixture of polyethylene glycol and polyvinyl alcohol at a content of 20 ppm or more as an additive.

(b) When a molecular weight of the polyethylene glycol is given as Z and a current density during the electrolysis is given as X ($A/dm^2$), the electrolysis is performed under conditions that fulfill the following relational expressions, $$1000 \leq Z \leq 2000$$

$$1.2-(Z-1000)\times 0.0008 \leq X \leq 2.2-(Z-1000)\times 0.001.$$

2 Claims, 2 Drawing Sheets

HIGH-PURITY ELECTROLYTIC COPPER AND ELECTROLYTIC REFINING METHOD THEREOF

TECHNICAL FIELD

The present invention relates to a high-purity electrolytic copper including a low content of impurities such as sulfur (S) and the like, and an electrolytic refining method thereof. More particularly, the present invention relates to a high-purity electrolytic copper having characteristics of not being brittle, not being peeled off, and having good productivity, and an electrolytic refining method thereof.

The present application claims priority on Japanese Patent Application No. 2012-134722, filed on Jun. 14, 2012, the content of which is incorporated herein by reference.

BACKGROUND ART

Hitherto, in electrolytic refining of copper, during electrolytic refining using copper sulfate, contents of particularly silver (Ag) and S cannot be reduced, and it is difficult to obtain high-purity electrolytic copper having a purity of 5N (99.999%) or higher. Therefore, electrolytic refining using copper nitrate is performed (for example, Patent Document 1). In addition, it is known that a bath temperature is temporarily lowered and electrolytic refining is performed in two stages so as to reduce a content of impurities (for example, Patent Document 2). Moreover, it is also known that polyethylene glycol (PEG) or polyvinyl alcohol (PVA) is used as an additive so as to further reduce the contents of Ag and S (for example, Patent Document 3), and the PEG and PVA are synthetic polymer additives which do not include S and are stable, and the PEG and PVA include low contents of impurities (for example, Patent Document 3).

Recently, in the case where the high-purity electrolytic copper is used as a bonding wire, a concentration of impurities, particularly a content of S is the cause of wire fracture. Therefore, there is a strong demand for a reduction in the content of S.

However, in the electrolytic refining using copper nitrate as disclosed in J Patent Document 1, there is a problem in that the content of S can be reduced to only about 0.05 ppm. In addition, in the method of performing electrolytic refining in the two stages as disclosed in Patent Document 2, refining needs to be performed through electrolysis in the two stages while temporarily reducing the bath temperature to 10° C. or less and removing impurities using a filter. Therefore, there is a problem in that facility cost becomes high.

In the method of using PEG or PVA which does not contain S as an additive as disclosed in Patent Document 3, the content of S in the deposited high-purity electrolytic copper can be reduced to 0.005 ppm or less; and therefore, quality can be improved.

However, for example, in the case where PEG 1000 and the PVA 500 (1000 and 500 represent molecular weights) are used, there is no problem when a small cathode (SUS plate) which is a square where a length of each side is less than 30 cm (the area is less than 900 $cm^2$) is used. However, when electrolysis is performed by using a large cathode (SUS plate) which is a square where a length of each side is 30 cm or more (the area is 900 $cm^2$ or more), a phenomenon occurs in which high-purity electrolytic copper deposited on the cathode becomes very, brittle. Therefore, the deposited high-purity electrolytic copper is broken when being peeled off from the SUS plate. As a result, the yield of the high-purity electrolytic copper which proceeds to casting as the subsequent process is degraded. Therefore, there is a problem in that the productivity of high-purity electrolytic copper as the end product is greatly reduced.

On the other hand, when the molecular weight of the additive is increased (a molecular weight of PEG is in a range of 2000 or more) the brittleness is improved; however, a tensile stress is generated in the cathode (high-purity electrolytic copper) during the electrolysis due to the increase in the molecular weight. When the tensile stress is increased, the cathode (high-purity electrolytic copper) warps and is peeled off from the SUS plate during the electrolysis. Even in this phenomenon, in the case where the small cathode (SUS plate) which is a square where a length of each side is less than 30 cm (the area is less than 900 $cm^2$) is used and the electrolysis time is short, the cathode (high-purity electrolytic copper) is rarely peeled off although the cathode warps. Therefore, there is no particular problem. However, in the case of mass production, it is essential to perform electrolysis at a current density as high as possible using a cathode having a large area. Under this condition, there is a problem in that high-purity electrolytic copper deposited on the cathode is easily peeled off, and the high-purity electrolytic copper is peeled off from the cathode plate and falls into an electrolytic cell during the electrolysis.

PRIOR ART DOCUMENT

Patent Document

Patent Document 1: Japanese Examined Patent Application, Second Publication No. H03-4629

Patent Document 2: Republished Japanese Translation No. 2006-134724 of the PCT International Publication for Patent Application (PCT International Publication No. WO2006/134724)

Patent Document 3: Japanese Patent No. 4518262

DISCLOSURE OF THE INVENTION

Problems to be Solved by the Invention

A technical object to be accomplished by the present invention, that is, an object of the present invention is to provide an electrolytic refining method of high-purity electrolytic copper which fulfills the following three conditions and the high-purity electrolytic copper obtained by the same, even in the case where electrolytic refining of the high-purity electrolytic copper is performed by using a cathode plate having a large area (for example, a square where a length of each side is 100 cm).

(1) The high-purity electrolytic copper deposited on the cathode plate has the sufficient rigidity.

(2) The high-purity electrolytic copper deposited on the cathode plate is not peeled off during electrolysis.

(3) The productivity can be improved by performing the electrolysis at an increased current density.

Means for Solving the Problems

The inventors obtains knowledge that, in the case where electrolytic refining of high-purity electrolytic copper is performed under electrolysis conditions that fulfill the following (d) together with any one of the following (a) to (c), high-purity electrolytic copper which is not brittle (1) and is not peeled off (2) is obtained even when a cathode having a large area (for example, a square where a length of each side is 100 cm) is used.

(a) In the case where a molecular weight of PEG is 1000, a current density is in a range of 1.2 to 2.2 A/dm$^2$.

(b) In the case where a molecular weight of PEG is 1500, a current density is in a range of 0.8 to 1.7 A/dm$^2$.

(c) In the case where a molecular weight of PEG is 2000, a current density is in a range of 0.4 to 1.2 A/dm$^2$.

(d) A concentration of an additive in an electrolyte is in a range of 20 ppm or more (an addition amount converted into a basic unit (consumption rate) is 500 mg or more per 1 kg of deposited copper).

The inventors ascertained that the high-purity electrolytic copper obtained under electrolysis conditions that fulfill the above-described (d) together with any one of above-described (a) to (c) has an S content of 0.01 ppm or less, and has excellent rigidity and excellent resistance to peeling. Moreover, the inventors also ascertained that crystallite diameters and orientation indexes of the high-purity electrolytic copper have a predetermined relationship. The relationship between the electrolysis conditions which have been sought without a reliable seeking method until now, mechanical properties of the deposited high-purity electrolytic copper, and crystal structure was clarified, and a way of electrolytically refining high-purity electrolytic copper having a high quality at a high productivity level with good reproducibility was developed.

An aspect of the present invention is based on the above-described knowledge, and has the following features.

An electrolytic refining method of the high-purity electrolytic copper according to an aspect of the present invention includes: performing electrolysis by using an electrolyte which includes a copper nitrate solution, a cathode made of stainless steel, and an anode made of copper so as to deposit high-purity electrolytic copper on the cathode, and the electrolysis is performed under the following conditions.

(a) The electrolyte includes a mixture of polyethylene glycol and polyvinyl alcohol at a content of 20 ppm or more as an additive.

(b) When a molecular weight of the polyethylene glycol is given as Z and a current density during the electrolysis is given as X (A/dm$^2$), the electrolysis is performed under conditions that fulfill the following relational expressions.

$$1000 \leq Z \leq 2000$$

$$1.2-(Z-1000)\times 0.0008 \leq X \leq 2.2-(Z-1000)\times 0.001$$

A high-purity electrolytic copper according to an aspect of the present invention is obtained by the electrolytic refining method according to the aspect of the present invention, and has the following characteristics.

(a) A content of S in the high-purity electrolytic copper is in a range of 0.01 ppm or less.

(b) A crystallite diameter on an electrolyte surface side of the high-purity electrolytic copper is in a range of 400 nm or less.

(c) A crystallite diameter on a cathode side of the high-purity electrolytic copper is in a range of 140 nm or more.

(d) An orientation index of the high-purity electrolytic copper on the cathode side fulfills the following relational expression.

an orientation index of (1, 1, 1) crystal face>an orientation index of (2, 2, 0) crystal face

Effects of the Invention

According to the electrolytic refining method according to the aspect of the present invention, without the need for extensive facilities, the high-purity electrolytic copper can be obtained which has a large area, excellent rigidity, and excellent resistance to peeling, and a content of S in the electrolytic copper is in a range of 0.01 ppm or less. Therefore, the high-purity electrolytic copper having high quality and high productivity can be provided.

BEST MODE FOR CARRYING OUT THE INVENTION

Figure 1:
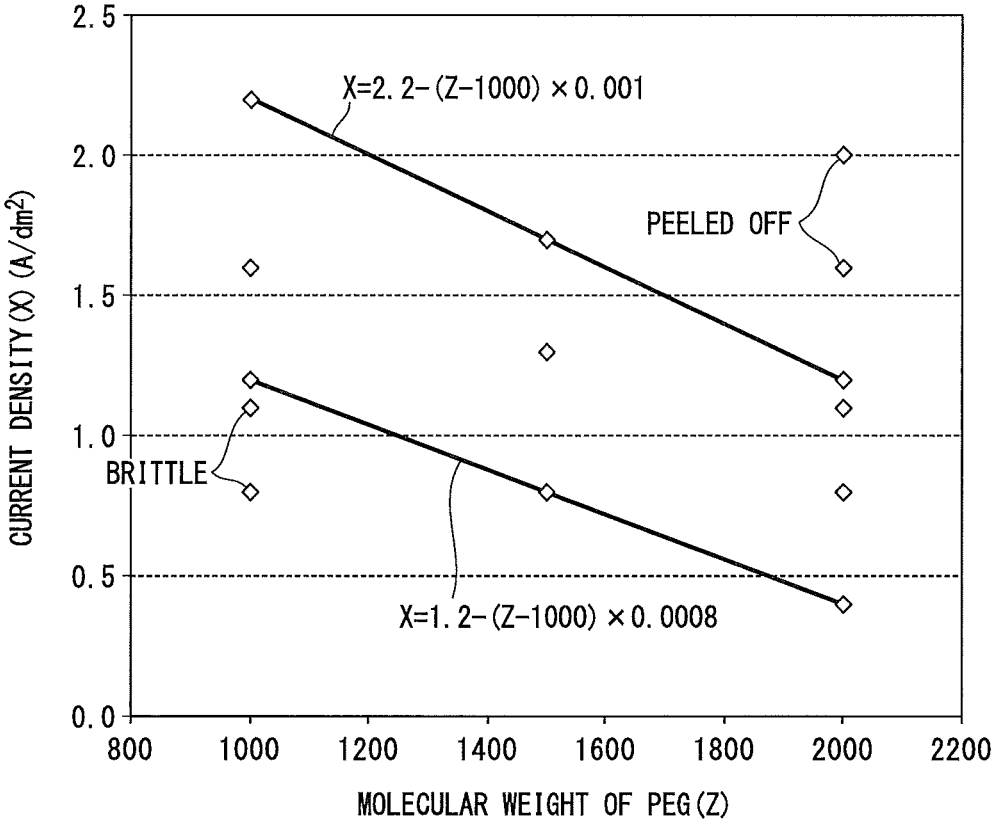
FIG. 1 is a graph showing results obtained by performing electrolysis under conditions where a molecular weight of PEG and a current density are set to various values and evaluating peeling and brittleness of high-purity electrolytic coppers.

An embodiment will be described in detail.

The most important features of an electrolytic refining method of high-purity electrolytic copper of the present embodiment are the control of a concentration of a mixture of additives of polyethylene glycol (PEG) and polyvinyl alcohol (PVA) which are contained in an electrolyte, and the control of a current density during electrolysis according to a molecular weight of PEG First, the first feature is the control of the content of the additives to be in a range of 20 ppm or more. The additives are consumed during electrolysis; and therefore, an appropriate amount thereof is always replenished. In addition, even in the case where the content of the additives are reduced due to factors (dilution of the electrolyte) other than the consumption of the additives during the electrolysis, the content of the additives is controlled to always be maintained in a range of 20 ppm or more. Thereby, the electrolysis can be stably performed. Here, the reason that the content of the additives is set to be in a range of 20 ppm or more is described as follows. The additives have effects of smoothing a cathode plane during the electrolysis and suppressing codeposition of impurities. However, in the case where the content of the additives is less than 20 ppm, these effects are not sufficiently exhibited; and thereby, high-purity electrolytic copper having a high purity and high quality cannot be obtained. On the other hand, in the present embodiment, although the upper limit is not particularly limited, in the case where the content of the additives is more than 400 ppm, there is a tendency of the current efficiency of the anode to decrease. Therefore, the content of the additives is preferably in a range of 400 ppm or less. The content of the additives is more preferably in a range of 20 to 80 ppm. In addition, a mixing ratio (volume ratio) of an amount of PEG to an amount of PVA in the mixture of the additives is preferably in a range of 1 to 4.

In order to maintain the concentration of the additives in the electrolyte in a range of 20 ppm or more, 500 mg or more of the additives is needed per 1 kg of deposited copper when the added amount of the additives is converted into a basic unit (consumption rate). That is, 500 mg or more of the additives is needed per 1 kg of manufactured high-purity electrolytic copper (deposited copper). This amount is compared to that of the related art disclosed in Patent Document 3 described above as follows. An amount of only 300 mg of the additives is replenished per 1 kg of deposited copper in the related art disclosed in Patent Document 3. As a result, the high-purity electrolytic copper deposited on the cathode is brittle, and the crystallite diameter on the electrolyte surface side exceeds 400 nm. Therefore, it can be seen that the properties thereof are not sufficient compared to those of the invention products (refer to a comparative product 3 of the examples for details).

In addition, the second feature in the present embodiment is the appropriate control of the current density during the electrolysis according to the molecular weight of PEG.

That is, the inventors found that a large tensile stress is exerted on the high-purity electrolytic copper deposited on the cathode during the electrolysis as the molecular weight of PEG is increased. As the molecular weight of PEG is increased, an affinity with metal is increased, and adsorbability to the surface of the cathode is increased. Therefore, with the deposition of the high-purity electrolytic copper, a tensile stress is gradually accumulated in the high-purity electrolytic copper. As a result, a large stress is exerted on the high-purity electrolytic copper.

In view of the above-described findings, the inventors reduce the current density during the electrolysis as the molecular amount of PEG is increased; and thereby, the inventors have succeeded in obtaining high-purity electrolytic copper having high quality without applying an excessive stress to the high-purity electrolytic copper deposited on the cathode.

Specifically, when the molecular weight of PEG is given as Z and the current density during the electrolysis is given as X ($A/dm^2$), the electrolysis is performed under conditions in which the molecular weight of PEG Z fulfills $1000 \leq Z \leq 2000$, and the current density X fulfills the following relational expression.

$$1.2-(Z-1000)\times 0.0008 \leq X \leq 2.2-(Z-1000)\times 0.001$$

The molecular weight of PEG Z is preferably in a range of 1000 to 1500.

The reason that the electrolysis is performed under the conditions that fulfill the above-described relational expression is explained as follows. The inventors have conducted an examination using a data mining method (a technique of analyzing a large amount of data statistically and mathematically and finding laws and casual relationships); and as a result, the inventors have found that there is a relationship between the fact that the high-purity electrolytic copper is peeled off from the cathode during the electrolysis, the fact that the obtained high-purity electrolytic copper becomes brittle, and the current density, and the relationship fulfills the above-described relational expression.

FIG. 1 shows results obtained by performing electrolysis under conditions where a molecular weight of PEG (Z) and a current density (X) are set to various values and evaluating peeling and brittleness of high-purity electrolytic coppers.

In the case where the current density (X) was higher than a value calculated from $2.2-(Z-1000)\times 0.001$, peeling of the high-purity electrolytic copper occurred. That is, in the case where the electrolysis conditions plotted in FIG. 1 are located above the line of $2.2-(Z-1000)\times 0.001$, peeling occurs.

In the case where the current density (X) is lower than a value calculated from $1.2-(Z-1000)\times 0.0008$, the high-purity electrolytic copper became brittle. That is, in the case where the electrolysis conditions plotted in FIG. 1 are located below the line of $1.2-(Z-1000)\times 0.0008$, the high-purity electrolytic copper becomes brittle.

In view of the above-described results, the above-described relational expression is obtained.

In practice, the molecular weight of PEG which is commercially available is not arbitrarily selected, and is specified to a certain degree.

In the case of the present embodiment, PEG which is easy to be used is either one of PEGs having molecular weights of 1000, 1500, and 2000, and the electrolysis condition corresponding to each of the PEGs is as follows.

In the case where the molecular weight of PEG is 1000, the current density is in a range of 1.2 to 2.2 $A/dm^2$.

In the case where the molecular weight of PEG is 1500, the current density is in a range of 0.8 to 1.7 $A/dm^2$.

In the case where the molecular weight of PEG is 2000, the current density is in a range of 0.4 to 1.2 $A/dm^2$.

The high-purity electrolytic copper of the present embodiment is obtained by the electrolytic refining method of the present embodiment.

A content of S in the high-purity electrolytic copper is in a range of 0.01 ppm or less.

A crystallite diameter on an electrolyte surface side (a crystallite diameter in a surface contact to the electrolyte) of the high-purity electrolytic copper is in a range of 400 nm or less, preferably in a range of 200 to 400 nm, and more preferably in a range of 290 to 350 nm.

A crystallite diameter on a cathode side (a crystallite diameter in a surface contact to the cathode) of the high-purity electrolytic copper is in a range of 140 nm or more, preferably in a range of 140 to 200 nm, and more preferably in a range of 155 to 170 nm.

An orientation index of the high-purity electrolytic copper on the cathode side fulfills the following relational expression.

an orientation index of (1, 1, 1) crystal face>an orientation index of (2, 2, 0) crystal face According to the above-described characteristics, the high-purity electrolytic copper of the present embodiment includes 0.01 ppm or less of S and has excellent rigidity and excellent resistance to peeling.

EXAMPLES

The embodiment of the present invention will be described in detail according to Examples and Comparative Examples.

Here, in the following Examples and Comparative Examples, compounds of PEG and PVA which are available commercially were used as additives. However, in the electrolytic refining method of high-purity electrolytic copper of the present embodiment, the additives are not limited to the compounds of PEG and PVA which are available commercially, and any compounds of PEG and PVA may be used if the compounds and electrolysis conditions fulfill the following conditions (a) and (b).

(a) An electrolyte includes a mixture of PEG and PVA at a content of 20 ppm or more as an additive.

(b) When a molecular weight of the PEG is given as Z and a current density during the electrolysis is given as X ($A/dm^2$), the electrolysis is performed under conditions that fulfill the following relational expressions.

$$1000 \leq Z \leq 2000$$

$$1.2-(Z-1000)\times 0.0008 \leq X \leq 2.2-(Z-1000)\times 0.001$$

A content of S in an electrolyte including a copper nitrate solution was adjusted to be in a range of 1 ppm or less. As the additives, PEGs having molecular weights of 1000, 1500, and 2000 and PVAs having molecular weights of 500 and 2000 were prepared. The PEG and the PVA were mixed at a volume ratio of 4:1, the mixture thereof was added to the electrolyte. While the content of the additives in the electrolyte was maintained at a predetermined value, electrolysis was performed at the current density shown in Table 1. The bath temperature was set to 30° C. in all the Examples.

A cathode was made of stainless steel, and the dimensions of the cathode are 100 cm×100 cm.

In the manufacturing processes of Invention Products 1 to 10 and Comparative Products 1, 2, 4, and 5, in order to maintain the content of the additives in the electrolyte at 40 ppm, the addition amount converted into a basic unit (consumption rate) was set to 900 mg per 1 kg of deposited copper. That is, 900 mg of the additives was added per 1 kg of high-purity electrolytic copper (deposited copper) to be manufactured.

In the manufacturing process of Comparative Product 3, in order to set the content of the additives in an electrolyte to be in a range of less than 20 ppm, the addition amount thereof converted in a basic unit (consumption rate) was set to 150 mg per 1 kg of deposited copper.

In all the Examples, the electrolysis time was 5 days.

Under the above-described conditions, Invention Products 1 to 10 and Comparative Products 1 to 5 were manufactured. Then, for the high-purity electrolytic coppers of Invention Products 1 to 10 and Comparative Products 1 to 5, crystallite diameters on the electrolyte surface side, crystallite diameters on the cathode side, and orientation indices of crystals on the cathode side were measured, and presence or absence of peeled-off portions from the cathode was observed. In addition, brittlenesses and stresses of the deposited high-purity electrolytic coppers were measured. These results are shown in Table 1.

The crystallite diameters were measured by the following method. It can be assumed that high-purity electrolytic copper has sufficiently large crystallite diameters and does not have lattice strain. Therefore, by an X-ray diffraction method (XRD method), crystallite diameters in a polished surface of the surface of the cathode side of the high-purity electrolytic copper and crystallite diameters in a polished surface of the surface of the electrolyte surface side were measured (measured by AXS D8 Advance manufactured by Bruker BioSpin K.K.). Specifically, diffraction lines were obtained by irradiating X-rays to each of the polished surfaces, crystallite diameters were calculated from the obtained diffraction lines using TOPAS which is an analysis software manufactured by Bruker BioSpin K.K.

In addition, among diffraction peaks obtained from the polished surface of the surface of the cathode side, particularly the diffraction peak from (1, 1, 1) crystal face and the diffraction peak from (2, 2, 0) crystal face were compared to each other. Thereby, the orientation index of the high-purity electrolytic copper on the cathode side was obtained (measured by AXS D8 Advance manufactured by Bruker BioSpin K.K.). Specifically, the diffraction intensity of the (1, 1, 1) diffraction peak was used as the orientation index of (1, 1, 1) crystal face, and the diffraction intensity of the (2, 2, 0) diffraction peak was used as the orientation index of the (2, 2, 0) crystal face. Then, the orientation index of the (1, 1, 1) crystal face and the orientation index of the (2, 2, 0) crystal face were compared to each other.

A specific measurement method of the XRD method will be described as follows. The AXS D8 Advance manufactured by Bruker BioSpin K.K. was used as a measuring device, and CuKα·1.54 Å was used as a tube·wavelength. The obtained high-purity electrolytic copper was cut into a sheet having dimensions of 1.5 cm×1.5 cm, and with regard to the surface on the electrolyte surface side and the surface on the cathode side, XRD patterns in a range of 2θ=40 to 100° were measured.

The presence or absence of peeled-off portions from the cathode was visually observed. Those having any peeled-off portions from the surface of the cathode made of stainless steel were evaluated as "presence" of peeled-off portions.

Figure 2:
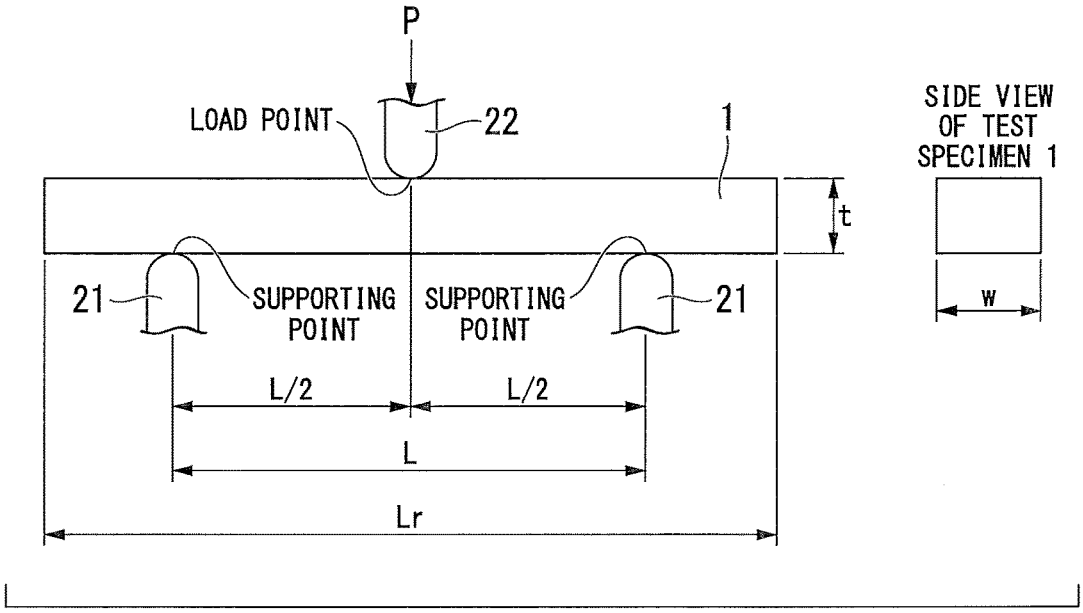
FIG. 2 is a schematic diagram of a three point bending test.

In addition, the brittleness was evaluated by the following method. A test specimen 1 having dimensions of 15 mm (width W)×50 mm (length Lr)×0.25 mm (thickness t) was cut out from each sample (high-purity electrolytic copper), and a three point bending test as shown in FIG. 2 was performed. Specifically, two supports 21 were disposed so that the distance L between the supporting points was 25 mm, and the test specimen 1 was disposed on the supports 21. An indenter 22 was disposed on the perpendicular line which passed through the midpoint of the distance L between the supporting points to come into contact with the surface of the test specimen 1. In addition, the radius of curvature of the tip of the support 21 was 5 mm, and the radius of curvature of the tip of the indenter 22 was 5 mm.

A load P was applied to the test specimen 1 from the indenter 22. Those that were broken under a load at a test speed of 5 mm/min were evaluated as "presence" (broken portions were present and the sample was brittle), and those that were not broken were evaluated as "absence" (broken portions were absent and the sample was not brittle).

The stress was measured by the strip stress measuring method. This strip stress measuring method is one of methods for evaluating an internal stress in a plated film. As a measuring device, a strip-type electrodeposition stress tester manufactured by Fijikasei Co., Ltd. was used.

In addition, with regard to the Invention Products 1 to 10 and Comparative Products 1 to 5, the contents of S were measured by glow-discharge mass spectrometry (GDMS). As a result, in all the specimens, the contents of S were in a range of 0.01 ppm or less. Moreover, the content of metal impurities except for Cu, C, S, N, H, O, Cl, and F (elements to be measured were 46 elements in total such as Ag, Al, and the like) was measured. As a result, it could be confirmed that in all the specimens, the total contents of the metal impurities were in a range of 1 ppm or less, that is, the high-purity electrolytic coppers had purities of 6N or higher.

In addition, from the results of Table 1, it was confirmed that it is necessary to perform electrolysis under the following conditions in order to solve the conventional problems regarding "peeling-off" and "brittleness".

In the case where the molecular weight of PEG is 1000, the current density is set to be in a range of 1.2 to 2.2 A/dm$^2$.

In the case where the molecular weight of PEG is 2000, the current density is set to be in a range of 0.4 to 1.2 A/dm$^2$.

In addition, as a result of comparing Invention Products 1 to 9 with Invention Product 10, it could be confirmed that the molecular weight of PVA used along with PEG as the additive does not make a meaningful difference in the effect of the present invention.

TABLE 1

| Type | Molecular Weight of PEG (Z) | Molecular Weight of PVA | PEG:PVA | Current Density (A/dm$^2$) (X) | Content of Additives | Crystallite Diameter on Electrolyte Surface Side (nm) | Crystallite Diameter on Cathode Side (nm) | Orientation Index | Peeling-off | Brittleness | Stress (N/mm$^2$) |
|---|---|---|---|---|---|---|---|---|---|---|---|
| Invention Product 1 | 1000 | 500 | 4:1 | 2.2 | 40 ppm | 341 | 154 | (1, 1, 1) > (2, 2, 0) | Absence | Absence | 0.8 |
| Invention Product 2 | 1500 | 500 | 4:1 | 1.7 | 40 ppm | 291 | 154 | (1, 1, 1) > (2, 2, 0) | Absence | Absence | 1.8 |

TABLE 1-continued

| Type | Molecular Weight of PEG (Z) | Molecular Weight of PVA | PEG:PVA | Current Density ($A/dm^2$) (X) | Content of Additives | Crystallite Diameter on Electrolyte Surface Side (nm) | Crystallite Diameter on Cathode Side (nm) | Orientation Index | Peeling-off | Brittleness | Stress ($N/mm^2$) |
|---|---|---|---|---|---|---|---|---|---|---|---|
| Invention Product 3 | 2000 | 500 | 4:1 | 1.2 | 40 ppm | 338 | 163 | (1, 1, 1) > (2, 2, 0) | Absence | Absence | 2.8 |
| Invention Product 4 | 1000 | 500 | 4:1 | 1.6 | 40 ppm | 353 | 160 | (1, 1, 1) > (2, 2, 0) | Absence | Absence | −7.6 |
| Invention Product 5 | 1500 | 500 | 4:1 | 1.3 | 40 ppm | 362 | 161 | (1, 1, 1) > (2, 2, 0) | Absence | Absence | −3.8 |
| Invention Product 6 | 2000 | 500 | 4:1 | 0.8 | 40 ppm | 328 | 170 | (1, 1, 1) > (2, 2, 0) | Absence | Absence | −2.8 |
| Invention Product 7 | 1000 | 500 | 4:1 | 1.2 | 40 ppm | 369 | 162 | (1, 1, 1) > (2, 2, 0) | Absence | Absence | −13.2 |
| Invention Product 8 | 1500 | 500 | 4:1 | 0.8 | 40 ppm | 368 | 177 | (1, 1, 1) > (2, 2, 0) | Absence | Absence | −10.8 |
| Invention Product 9 | 2000 | 500 | 4:1 | 0.4 | 40 ppm | 352 | 189 | (1, 1, 1) > (2, 2, 0) | Absence | Absence | −8.4 |
| Invention Product 10 | 2000 | 2000 | 4:1 | 1.2 | 40 ppm | 365 | 181 | (1, 1, 1) > (2, 2, 0) | Absence | Absence | 2.5 |
| Comparative Product 1 | 2000 | 500 | 4:1 | 2 | 40 ppm | 363 | 118 | (1, 1, 1) < (2, 2, 0) | Presence | Absence | 14 |
| Comparative Product 2 | 2000 | 500 | 4:1 | 1.6 | 40 ppm | 365 | 124 | (1, 1, 1) < (2, 2, 0) | Presence | Absence | 8.4 |
| Comparative Product 3 | 2000 | 500 | 4:1 | 1.1 | less than 20 ppm | 405 | 268 | (1, 1, 1) < (2, 2, 0) | Absence | Presence | 1.4 |
| Comparative Product 4 | 1000 | 500 | 4:1 | 0.8 | 40 ppm | 436 | 161 | (1, 1, 1) < (2, 2, 0) | Absence | Presence | −18.8 |
| Comparative Product 5 | 1000 | 500 | 4:1 | 1.1 | 40 ppm | 431 | 164 | (1, 1, 1) < (2, 2, 0) | Absence | Presence | −14.6 |

As can be seen from the results of Table 1, the high-purity electrolytic coppers of Invention Products 1 to 10 were manufactured under the electrolysis conditions that fulfilled the conditions of the present embodiment. It could be confirmed that all the Invention Products 1 to 10 were not peeled off from the cathode and had the sufficient rigidity. In addition, it was also confirmed that the high-purity electrolytic coppers (Invention Products 1 to 10) which were not peeled off and had sufficient rigidity (were not brittle) had the following characteristics.

The crystallite diameters on the electrolyte surface side were in a range of 400 nm or less.

The crystallite diameters on the cathode side were in a range of 140 nm or more.

On the cathode side, the orientation index of (1, 1, 1) crystal face was larger than the orientation index of (2, 2, 0) crystal face.

On the other hand, the high-purity electrolytic coppers of Comparative Products 1 to 5 were refined (manufactured) under the electrolysis conditions which did not fulfill the conditions of the present embodiment. It could be confirmed that Comparative Products 1 to 5 were inferior in any of peeling-off and brittleness.

INDUSTRIAL APPLICABILITY

As described above, according to the present embodiment, the high-purity electrolytic copper having a large area can be refined (manufactured). In addition, the high-purity electrolytic copper is not peeled off from the cathode during electrolysis, and the high-purity electrolytic copper is not brittle and broken when the high-purity electrolytic copper is peeled off from the cathode. Therefore, the productivity of the high-purity electrolytic copper can be greatly increased. As a result, it is possible to obtain a copper material which has a reduced hardness and is thus appropriate for thinning. Particularly, it is possible to thin a conductor for an audio cable for high-quality sound or a bonding wire for a semiconductor device for high-speed and high-quality transmission of a signal.

The invention claimed is:

1. An electrolytic refining method of high-purity electrolytic copper, the method comprising:

performing electrolysis by using one electrolyte which includes a copper nitrate solution, a cathode made of stainless steel, and an anode made of copper so as to deposit high-purity electrolytic copper on the cathode, wherein (a) the electrolyte includes a mixture of polyethylene glycol and polyvinyl alcohol at a content of 20 ppm or more as an additive, (b) polyethylene glycol and polyvinyl alcohol are mixed to prepare a replenishment mixture thereof, and 500 mg or more of the replenishment mixture of polyethylene glycol and polyvinyl alcohol is added to the electrolyte per 1 kg of deposited copper in the electrolyte, and thereby, a content of the mixture of polyethylene glycol and polyvinyl alcohol in the electrolyte is maintained in a range of 20 ppm or more while the electrolysis is performed, and (c) when a molecular weight of the polyethylene glycol is given as Z and a current density during the electrolysis is given as X ($A/dm^2$), the electrolysis is performed under conditions that fulfill the following relational expressions, $$1000 \leq Z \leq 2000$$

$$1.2-(Z-1000)\times 0.0008 \leq X \leq 2.2-(Z-1000)\times 0.001.$$

2. The electrolytic refining method of high-purity electrolytic copper according to claim 1, wherein the polyethylene glycol and the polyvinyl alcohol of the replenishment mixture are mixed at a volume ratio of polyethylene glycol:polyvinyl alcohol=4:1, and the mixture of polyethylene glycol and polyvinyl alcohol in the electrolyte has a volume ratio of polyethylene glycol:polyvinyl alcohol=4:1, (a) a content of S in the deposited high-purity electrolytic copper is in a range of 0.01 ppm or less, (b) a crystallite diameter on an electrolyte surface side of the deposited high-purity electrolytic copper is in a range of 400 nm or less, (c) a crystallite diameter on a cathode side of the deposited high-purity electrolytic copper is in a range of 140 nm or more, and (d) an orientation index of the deposited high-purity electrolytic copper on the cathode side fulfills the following relational expression, an orientation index of (1, 1, 1) crystal face>an orientation index of (2, 2, 0) crystal face.

* * * * *